US009982391B2

(12) United States Patent
Fujita

(10) Patent No.: US 9,982,391 B2
(45) Date of Patent: May 29, 2018

(54) SHEET MANUFACTURING APPARATUS

(71) Applicant: SEIKO EPSON CORPORATION, Tokyo (JP)

(72) Inventor: Shigeo Fujita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 14/959,334

(22) Filed: Dec. 4, 2015

(65) Prior Publication Data

US 2016/0168795 A1 Jun. 16, 2016

(30) Foreign Application Priority Data

Dec. 12, 2014 (JP) ..... 2014-251803

(51) Int. Cl.
*D21F 9/00* (2006.01)

(52) U.S. Cl.
CPC ..... *D21F 9/00* (2013.01)

(58) Field of Classification Search
USPC ..... 162/261, 289, 308, 311–314, 361
See application file for complete search history.

(56) References Cited

U.S. PATENT DOCUMENTS 4,668,339 A * 5/1987 Terry ..... D21B 1/08 162/13
6,030,497 A * 2/2000 Watkins, Jr. ..... B32B 29/00 162/103
7,134,859 B1 * 11/2006 Sorensen ..... D21B 1/06 425/82.1
8,257,553 B2 * 9/2012 Zwick ..... C11D 3/046 162/158
8,882,965 B2 * 11/2014 Yamagami ..... D21B 1/08 162/261
9,039,868 B2 * 5/2015 Nagai ..... D21H 25/04 162/252
9,115,840 B2 * 8/2015 Sinadinos ..... F16L 55/033
9,463,579 B2 * 10/2016 Oguchi ..... D04H 1/732
9,498,896 B2 * 11/2016 Oguchi ..... B27N 3/04
2014/0060347 A1 * 3/2014 Sahebkar Yazdi ..... B30B 9/121 100/39

FOREIGN PATENT DOCUMENTS

EP 2664708 B1 * 11/2013
JP 50-69306 A 10/1973
JP 2012-144819 A * 8/2012

* cited by examiner

*Primary Examiner* — Dennis R Cordray
(74) *Attorney, Agent, or Firm* — Workman Nydegger

(57) ABSTRACT

A sheet manufacturing apparatus includes a defibrating unit, a forming unit, and an operation unit. The defibrating unit defibrates a raw material that contains fiber in air. The forming unit forms a sheet by using at least a part of a defibrated material after defibration by the defibrating unit. The operation unit is for operation of the sheet manufacturing apparatus. When the side where the operation unit is located is defined as the front side, the defibrating unit is located at the rear side, and the forming unit is located at the front side.

4 Claims, 4 Drawing Sheets

SHEET MANUFACTURING APPARATUS

BACKGROUND

1. Technical Field

The present invention relates to a sheet manufacturing apparatus.

2. Related Art

A technique for manufacturing paper by a dry method using wastepaper as a raw material is disclosed in JP-A-50-069306. A wastepaper recycle apparatus illustrated in FIG. 1 of JP-A-50-069306 has a single-line structure in which a turbo cutter (fiber crusher), a turbo mill for dry disintegration, adjustment, and mixing, a cyclone for removing any foreign object, a screen for removing any yet-to-be-defibrated fiber, etc., a sheet forming apparatus that forms a sheet, a pickup apparatus, a smooth press, a drier, and a pope reel are arranged in a line.

However, the wastepaper recycle apparatus disclosed in JP-A-50-069306 is horizontally long because it has a single-line structure in which all processing units are arranged in a line. Though there is no problem if the apparatus is installed in a factory, etc., it is too large to be installed in an office or in an open space in a warehouse, etc.

SUMMARY

An advantage of some aspects of the invention is to provide a sheet manufacturing apparatus that is shorter than a single-line counterpart and has a line size that is small enough to be installed in an office or a warehouse, etc.

The invention can be embodied in the following application examples or modes.

A sheet manufacturing apparatus according to one aspect of the invention comprises: a defibrating unit that defibrates a raw material that contains fiber in air; a forming unit that forms a sheet by using at least a part of a defibrated material after defibration by the defibrating unit; and an operation unit for operation of the sheet manufacturing apparatus; wherein, when a side where the operation unit is located is defined as a front side, the defibrating unit is located at a rear side, and the forming unit is located at the front side.

In this sheet manufacturing apparatus, the forming unit is provided at the front side, at which the operation unit is provided, and the defibrating unit is provided at the rear side. Since this front-and-rear two-line structure is shorter than a single-line structure, the apparatus has a line size that is small enough to be installed in an office or a warehouse, etc. Moreover, since the forming unit is located at the front side, troubleshooting is easier when a sheet transportation trouble occurred in the forming unit. Furthermore, since the dry-type defibrating unit, which produces a loud noise, is located at the rear side, a noise reduction is achieved.

In the sheet manufacturing apparatus of the invention, the forming unit may include a deposition unit for deposition of at least a part of the defibrated material, a heating roller for heating a deposited material, and a pressing roller for pressing the deposited material.

The heating roller needs to be replaced after a predetermined amount of use because of heat stress. The pressing roller also needs to be replaced after a predetermined amount of use because of pressure stress. Since the forming unit including these rollers is located at the front side, replacement is easier.

The sheet manufacturing apparatus of the invention may further comprise: a classifying unit that classifies the defibrated material, and includes, a cyclone-shaped body, and a catcher that is connected to an upper outlet of the body, and catches a discharged material put out through the upper outlet, wherein the body is located at the rear side, and the catcher is located at the front side.

Since the catcher, which requires maintenance after a predetermined period of use, is located at the front side of the apparatus, the ease of maintenance of the catcher improves.

BRIEF DESCRIPTION OF THE DRAWINGS

The invention will be described with reference to the accompanying drawings, wherein like numbers reference like elements.

DESCRIPTION OF EXEMPLARY EMBODIMENTS

A preferred embodiment of the present invention will now be explained in detail by using the drawings. The specific embodiment described below is not for undue limitation of the scope of the invention recited in the appended claims. For implementation of the invention, it is not always necessary to combine all of elements described below.

First, with reference to FIG. 1, each processing unit in a sheet manufacturing apparatus according to the present embodiment will now be explained. Next, with reference to FIGS. 2, 3, and 4, the arrangement of the processing units in the sheet manufacturing apparatus will be explained.

1. Sheet Manufacturing Apparatus

1.1. Structure

First, with reference to the drawings, a sheet manufacturing apparatus according to the present embodiment will now be explained. FIG. 1 is a schematic view of a sheet manufacturing apparatus 100 according to the present embodiment.

Figure 1:
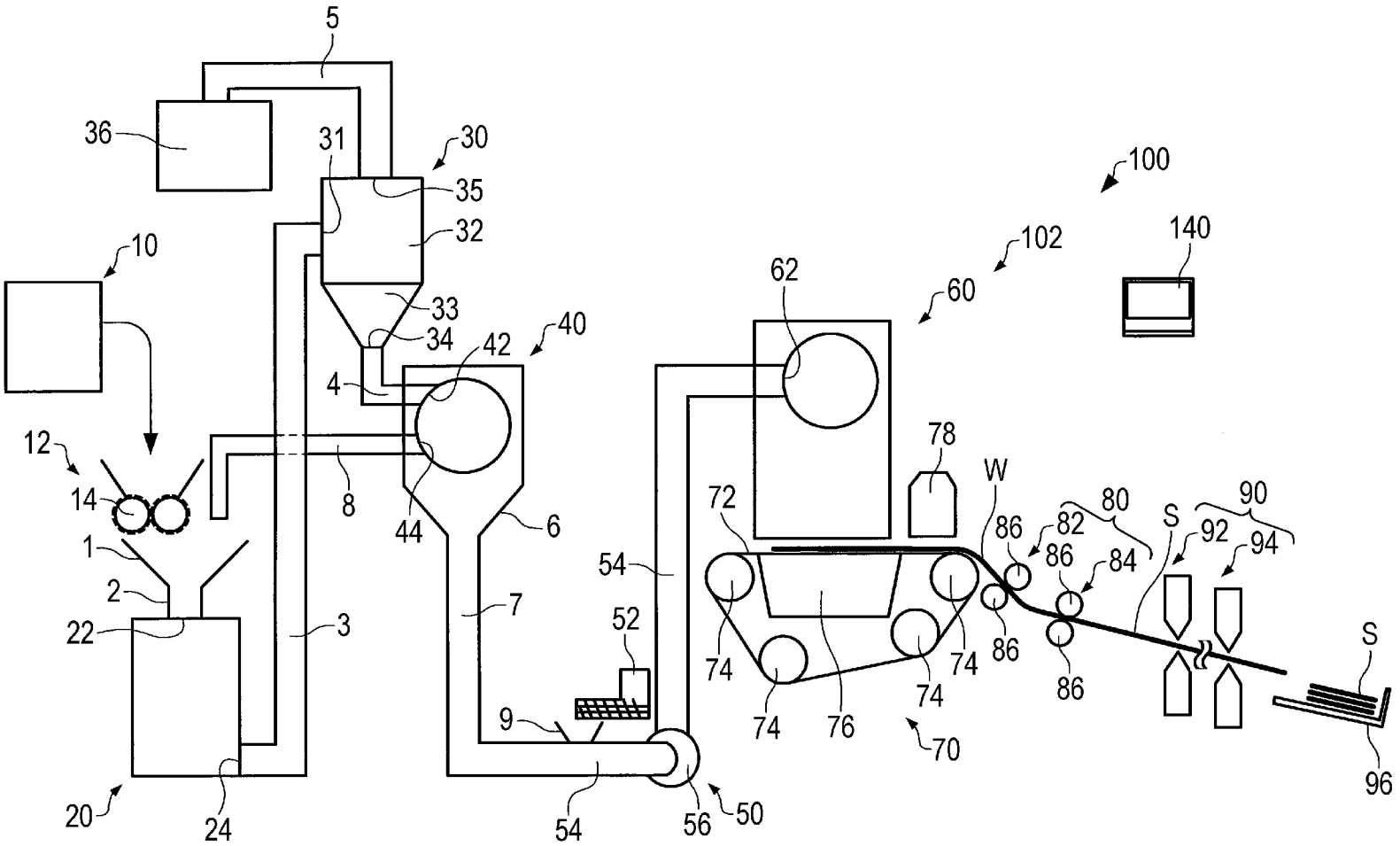
FIG. 1 is a schematic view of a sheet manufacturing apparatus according to an exemplary embodiment.

As illustrated in FIG. 1, the sheet manufacturing apparatus 100 includes a supplying unit 10, a manufacturing unit 102, and a control unit 140. The manufacturing unit 102 manufactures a sheet. The manufacturing unit 102 includes a crushing unit 12, a defibrating unit 20, a classifying unit 30, a screening unit 40, a mixing unit 50, a deposition unit 60, a web forming unit 70, a sheet forming unit 80, and a cutting unit 90.

The supplying unit 10 supplies a raw material to the crushing unit 12. For example, the supplying unit 10 is an automatic feeder for successive inputs of a raw material into the crushing unit 12.

The crushing unit 12 shreds the raw material supplied by the supplying unit 10 into small pieces in air. The small pieces are, for example, pieces of a few square centimeters. In the illustrated example, the crushing unit 12 has a crushing blade 14, and can shred the inputted raw material by means of the crushing blade 14. For example, a shredder is used as the crushing unit 12. After shredding by the crushing unit 12, the raw material is received by a hopper 1, and is transferred (transported) to the defibrating unit 20 through a pipe 2.

The defibrating unit 20 defibrates the raw material shredded by the crushing unit 12. The term "defibration" means the disentanglement of a raw material (defibration object) that is made up of plural fibers bonded to one another into pieces. In addition to the defibrating function, the defibrating unit 20 has a function of separating resin particles, ink, toner, and blur-preventing agent, etc. from the fibers of the raw material.

The output from the defibrating unit 20 is called as "defibrated material". The "defibrated material" sometimes contains, in addition to defibrated fibers, the particles of resin separated from the fibers during the defibration (binder resin for bonding the fibers to one another), a colorant such an ink, toner, etc., an additive such as blur-preventing agent, paper-strengthening agent, etc. The defibrated material has a string shape or a ribbon shape. The defibrated material may be in a state in which it is not intertwined with any other defibrated fiber (independent state), or may be in a state of so-called "lump", in which it is intertwined with other defibrated material.

The defibrating unit 20 performs dry defibration under atmospheric condition (in air). Specifically, an impeller mill is used as the defibrating unit 20. The defibrating unit 20 has a function of producing a flow of air for taking the raw material in, and for putting out the defibrated material. Therefore, the defibrating unit 20 can take the raw material in through an inlet 22 together with the self-produced airflow, perform defibration, and transport it to an outlet 24. The defibrated material that goes out from the defibrating unit 20 is transferred to the classifying unit 30 through a pipe 3.

The classifying unit 30 classifies the defibrated material outputted from the defibrating unit 20. Specifically, the classifying unit 30 separates and removes those that are comparatively small in size and those that are comparatively low in density in the defibrated material (resin particles, colorant, additive, etc). By this means, it is possible to increase the percentage of fibers that are comparatively large in size or comparatively high in density in the defibrated material.

An airflow classifier is used as the classifying unit 30. An airflow classifier generates a swirling airflow and performs separation by utilizing the difference in centrifugal force depending on the size and density of those that are to be classified. It is possible to adjust the point of classification by adjusting airflow velocity and centrifugal force. Specifically, a cyclone classifier, an elbow-jet classifier, or an eddy classifier, etc. can be used as the classifying unit 30. In particular, the illustrated cyclone classifier is suited for the classifying unit 30 because of its simple structure.

The classifying unit 30 has, for example, an inlet 31, a cylindrical portion 32, which is connected to the inlet 31, an inverted cone portion 33, which is located under the cylindrical portion 32 and is continuous from the cylindrical portion 32, a lower outlet 34, which is provided at the center of the bottom of the inverted cone portion 33, and an upper outlet 35, which is provided at the center of the top of the cylindrical portion 32.

The flow of the air entraining the defibrated material having entered through the inlet 31 turns into a circumferential flow inside the cylindrical portion 32 of the classifying unit 30. As a result of this swirling motion, the defibrated material is centrifugalized. By this means, the classifying unit 30 can separate, in the defibrated material, fibers (first classified material), which are larger in size and higher in density than resin particles and ink particles, from the resin particles, colorant, additive and the like (second classified material), which are smaller in size and lower in density than the fibers. The first classified material is put out through the lower outlet 34, and goes into the screening unit 40 through a pipe 4. On the other hand, the second classified material is put out through the upper outlet 35, and goes into a receiver portion 36 through a pipe 5.

The first classified material that goes out from the classifying unit 30 goes into the screening unit 40 through an inlet 42 to be screened thereat on the basis of fiber length. For example, a sieve is used as the screening unit 40. The screening unit 40 has a net structure (filter, screen), and can separate, in the first classified material, fibers or particles that are smaller than the meshes of the net (those passing through the net; first screened material) from fibers that are larger than the meshes of the net, yet-to-be-defibrated pieces, and lumps (those not passing through the net; second screened material). For example, the first classified material is received by a hopper 6, and is transferred to the mixing unit 50 through a pipe 7. The second screened material is put out from an outlet 44 to be returned to the defibrating unit 20 through a pipe 8. Specifically, the screening unit 40 is a cylindrical sieve that rotates when driven by a motor. Examples of the net of the screening unit 40 are: a wire net, an expanded metal net formed by drawing a metal plate with slits, and a punched metal net formed by punching holes through a metal plate by using a punching press machine, etc.

The mixing unit 50 mixes the first screened material, which has passed through the net of the screening unit 40, with an additive that contains resin. The mixing unit 50 includes an additive supply portion 52, which supplies the additive, a pipe 54, through which the screened material and the additive are transported, and a blower 56. In the illustrated example, the additive is supplied from the additive supply portion 52 to the pipe 54 by means of a hopper 9. The pipe 54 is connected from the pipe 7.

In the mixing unit 50, the blower 56 produces a flow of air, and the first screened material and the additive are transported while being mixed with each other inside the pipe 54. The mechanism for mixing the first screened material with the additive is not specifically limited. For example, a propeller that rotates at a high speed may be used for stirring them. The rotation of a container may be utilized as in a V-type mixer.

A screw feeder illustrated in FIG. 1, or a disk feeder that is not illustrated, etc. can be used as the additive supply portion 52. The additive supplied from the additive supply portion 52 contains resin for bonding the fibers to one another. At the point in time of the supply of the resin, the plural fibers have not been bonded yet. The resin melts during the process of passing through the sheet forming unit 80 to bond the fibers to one another.

The resin supplied from the additive supply portion 52 is thermoplastic resin or thermosetting resin. Examples of this resin are: AS resin, ABS resin, polypropylene, polyethylene, polyvinyl chloride, polystyrene, acryl, polyester, polyethylene terephthalate, polyphenylene ether, polybutylene terephthalate, nylon, polyamide, polycarbonate, polyacetal, polyphenylene sulfide, polyetherether ketone, and the like. Any of them may be used alone, or a mixture of any of them may be used. The additive supplied from the additive supply portion 52 may be fibrous or powdery.

The additive supplied from the additive supply portion 52 may contain, in addition to the fiber binder resin, a colorant for coloring the fibers, a coagulation inhibitor for preventing the fibers from coagulating, a flame-resistant agent that makes the fibers, etc. incombustible, etc. depending on the type of a sheet manufactured. The mixture that goes out from the mixing unit 50 (the mixture of the first screened material and the additive) is transferred to the deposition unit 60 through the pipe 54.

The mixture that goes out from the mixing unit 50 goes into the deposition unit 60 through an inlet 62. The deposition unit 60 disentangles the intertwined defibrated material (fibers), and drops them while dispersing them in air. If the resin of the additive supplied from the additive supply portion 52 is fibrous, the deposition unit 60 disentangles the intertwined resin. By this means, the deposition unit 60 can deposit the mixture uniformly on the web forming unit 70.

A rotatable cylindrical sieve is used as the deposition unit 60. The deposition unit 60 has a net, and drops fibers or particles that are smaller than the meshes of the net (those passing through the net) among those included in the mixture outputted from the mixing unit 50. The structure of the deposition unit 60 is, for example, the same as the structure of the screening unit 40.

The "sieve" of the deposition unit 60 does not necessarily have to have a screening function for any particular target substance. That is, the "sieve" used as the deposition unit 60 means a unit equipped with a net, and the deposition unit 60 may drop all of the mixture inputted into the deposition unit 60.

The web forming unit 70 forms a web W as a result of the deposition of the passing-through material, which have passed through the deposition unit 60. The web forming unit 70 includes, for example, a mesh belt 72, a tension roller 74, and a suction mechanism 76.

The material having passed through the openings (meshes of the net) of the deposition unit 60 settles on the mesh belt 72 while the mesh belt 72 is moving. A tension is applied to the mesh belt 72 by the tension roller 74. The mesh belt 72 is permeable to air, but is not permeable to the passing-through material. The mesh belt 72 moves due to the rotation of the tension roller 74. The web W is formed on the mesh belt 72 as a result of the successive settlement of the material having passed through the deposition unit 60 on the mesh belt 72 while the mesh belt 72 is moving. The mesh belt 72 is made of, for example, metal, resin, cloth, or nonwoven fabric.

The suction mechanism 76 is provided under the mesh belt 72 (opposite the deposition unit 60). The suction mechanism 76 can produce a downward flow of air (airflow from the deposition unit 60 toward the mesh belt 72. Because of the airflow produced by the suction mechanism 76, it is possible to suck the mixture dispersed in air by the deposition unit 60 onto the mesh belt 72. By this means, it is possible to increase the speed of discharge from the deposition unit 60. Moreover, since a downward flow is produced in the mixture drop path by the suction mechanism 76, it is possible to prevent the defibrated material and the additive from becoming entangled during the drop.

Through the above processes at the deposition unit 60 and the web forming unit 70 (web forming process), a soft fluffy web W that contains a lot of air is formed. The web W on the mesh belt 72 is transported to the sheet forming unit 80.

In the illustrated example, a moisture-adjusting unit 78 for adjusting the moisture of the web W is provided. The moisture-adjusting unit 78 can adjust the ratio of the web W to water by adding the water, or water vapor, to the web W.

The sheet forming unit 80 shapes and forms a sheet S by applying heat and pressure to the web W on the mesh belt 72. At the sheet forming unit 80, heat is applied to the mixture of the defibrated material and the additive in the web W, thereby bonding the fibers contained in the mixture to one another by means of the additive (resin).

For example, heating rollers (heater rollers), a heat press shaping machine, hot plates, a hot air blower, an infrared heater, or a flash fixation device can be used as the sheet forming unit 80. In the illustrated example, the sheet forming unit 80 includes a first bonding portion 82 and a second bonding portion 84. Each of the bonding portions 82 and 84 includes a pair of heating rollers 86. Since the bonding portion 82, 84 includes the heating rollers 86, as compared with a case where the bonding portion 82, 84 is a plate-type press machine (flat press machine), it is possible to produce the sheet S while transporting the web W consecutively. The number of the heating rollers 86 is not specifically limited.

The cutting unit 90 cuts the sheet S produced by the sheet forming unit 80. In the illustrated example, the cutting unit 90 includes a first cutting portion 92, which cuts the sheet S in the direction orthogonal to the direction of transportation of the sheet S, and a second cutting portion 94, which cuts the sheet S in the direction parallel to the transportation direction. For example, the second cutting portion 94 cuts the sheet S having passed through the first cutting portion 92.

The sheet S that has predetermined cut size is produced through the above process. The cut sheet S is ejected to an ejection receiver unit 96.

1.2. Arrangement

Figure 2:
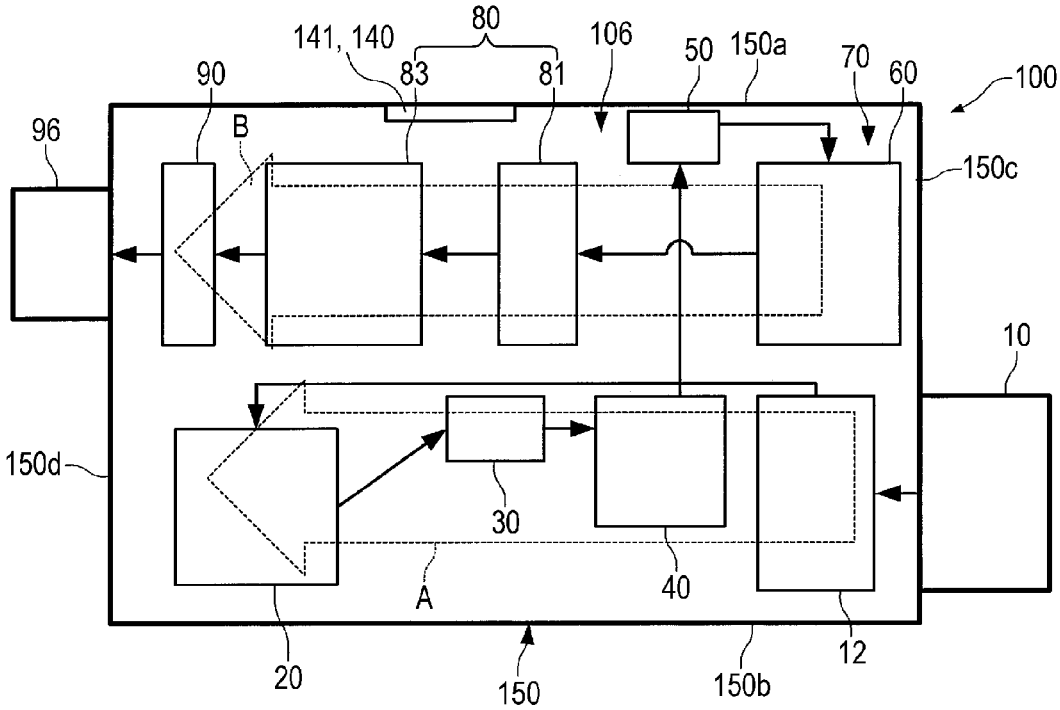
FIG. 2 is a plan view of the sheet manufacturing apparatus of the embodiment.

With reference to FIG. 2, the arrangement of the processing units in the sheet manufacturing apparatus 100 will now be explained. FIG. 2 is a plan view of the sheet manufacturing apparatus 100 according to the present embodiment. Since the structure of the processing units in the sheet manufacturing apparatus 100 illustrated in FIG. 2 has already been explained in "1.1. Structure" above, it is not explained here.

In FIG. 2, an operation unit 141 (control unit 140) for operating the sheet manufacturing apparatus 100 is provided in the front portion of the sheet manufacturing apparatus 100. When the side where the operation unit 141 is located is defined as the front side, the defibrating unit 20 is located at the rear side, and a forming unit 106 is located at the front side.

As illustrated in FIG. 2, the body 150 of the sheet manufacturing apparatus 100, excluding the supplying unit 10 and the ejection receiver unit 96, has a rectangular shape in plan view. The apparatus body 150 has first to fourth walls 150*a* to 150*d*. The first wall 150*a* is the front wall, which is located at the front of the sheet manufacturing apparatus 100 opposite the second wall 150*b*, which is the rear wall. The third wall 150*c* and the fourth wall 150*d*, which are sidewalls, are located for connection of the ends of the first wall 150*a* and the ends of the second wall 150*b*. The supplying unit 10 is located outside the apparatus body 150 adjacent to the third wall 150*c*. The ejection receiver unit 96 is located outside the apparatus body 150 adjacent to the fourth wall 150*d*. In the present embodiment, the first wall 150*a* and the second wall 150*b* are greater in length than the third wall 150*c* and the fourth wall 150*d*, and the apparatus body 150 has a rectangular shape in plan view. The first to fourth walls 150*a* to 150*d* are substantially rectangular plates of the same height. Therefore, the apparatus body 150 has a shape of a substantially rectangular parallelepiped.

The sheet manufacturing apparatus 100 includes two transportation lines for transporting the raw material or the sheet S, one (B) at the front side and the other (A) at the rear side. The supplying unit 10 is located next to the outer surface of the third wall 150*c* at a position relatively close to the second wall 150*b*. On the rear transportation line A, to which the supplying unit 10 is connected, the crushing unit 12, the screening unit 40, the classifying unit 30, and the defibrating unit 20 are arranged in this order at respective positions relatively close to the second wall 150*b* as viewed from the third wall 150*c* toward the fourth wall 150*d*. On the front transportation line B, the deposition unit 60, the mixing unit 50, the sheet forming unit 80 (pressuring unit 81, heating unit 83), and the cutting unit 90 are arranged in this order at respective positions relatively close to the first wall 150*a* as viewed from the third wall 150*c* toward the fourth wall 150*d*. The ejection receiver unit 96 is connected to the front transportation line B. The ejection receiver unit 96 is located next to the outer surface of the fourth wall 150*d* at a position relatively close to the first wall 150*a*. Because of the front-and-rear two-line structure described above, as compared with a single-line structure, it is possible to reduce the entire length of the apparatus. Therefore, the sheet manufacturing apparatus 100 has a line size that is small enough to be installed in an office or a warehouse, etc.

The sequential order of processing of the processing units explained in "1.1. Structure" above is indicated by solid-line arrows connecting the processing units in FIG. 2. The processing units will now be explained in the order of these arrows. On the rear transportation line A of the sheet manufacturing apparatus 100, a raw material is supplied from the supplying unit 10 into the apparatus body 150, and the raw material is crushed into pieces at the crushing unit 12 near the third wall 150*c*. The crushed pieces are transported to the defibrating unit 20 near the fourth wall 150*d*, and turns into a defibrated material at the defibrating unit 20. The defibrated material is classified at the classifying unit 30, which is located near the center of the apparatus body 150, to turn into the first classified material. The first classified material is screened at the screening unit 40 to turn into the first screened material. The first screened material is sent to the front transportation line B. On the front transportation line B of the sheet manufacturing apparatus 100, the first screened material is mixed with an additive that contains resin to turn into a mixture. The mixture is transported to the deposition unit 60 near the third wall 150*c*. The mixture is disentangled by the deposition unit 60, and a web is formed on the web forming unit 70 as a result of deposition. The web is transported to the sheet forming unit 80 to be shaped into a non-cut sheet thereat. The sheet is transported to the cutting unit 90 near the fourth wall 150*d* to be cut thereat. The cut sheet is ejected out of the apparatus body 150 into the ejection receiver unit 96.

Though the two-transportation-line structure is described in the present embodiment, the scope of the invention is not limited thereto. The number of transportation lines may be three or more. The transportation lines may extend in the front-rear direction.

2. Rear Transportation Line

Figure 3:
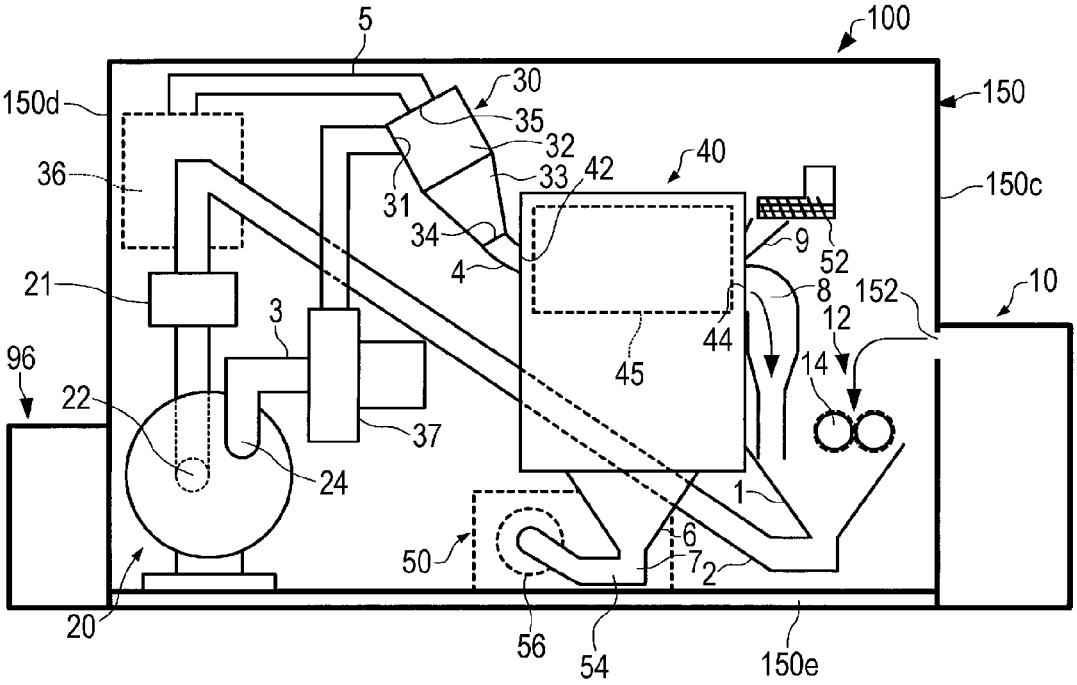
FIG. 3 is a rear view of the sheet manufacturing apparatus of the embodiment.

With reference to FIG. 3, the rear transportation line A will now be explained in detail. FIG. 3 is a rear view of the sheet manufacturing apparatus 100 according to the present embodiment.

As illustrated in FIG. 3, the rear transportation line A of the sheet manufacturing apparatus 100 includes the supplying unit 10, which supplies a raw material that contains fibers, the crushing unit 12, which crushes the raw material supplied from the supplying unit 10, the funnel-shaped hopper 1, which is a receiver that receives crushed pieces from the crushing unit 12, the defibrating unit 20, at which the crushed pieces turn into a defibrated material, and the pipe 2, through which the crushed pieces are transported from the hopper 1 to the defibrating unit 20.

The supplying unit 10 can be brought into contact with, and brought away from, the third wall 150*c* of the apparatus body 150. The supplying unit 10 feeds a raw material into the apparatus body 150 through a supply opening 152, which is an opening formed through the third wall 150*c*. Preferably, if possible, the supplying unit 10 should be installed at a low position in the sheet manufacturing apparatus 100. For example, in a case of a jam during feeding, it is easier to remove the raw material that caused the jam from the supplying unit 10 if the installed position of the supplying unit 10 is low. Moreover, if the installed position of the supplying unit 10 is low, a raw material that caused a jam inside the apparatus body 150 can be removed easily by, for example, sliding the wheeled (not illustrated) supplying unit 10 on the floor.

The apparatus body 150 has a base 150*e* on the office floor, etc., on which the sheet manufacturing apparatus 100 is installed. The first to fourth walls 150*a* to 150*d* are fixed to the base 150*e* and rise therefrom (for the first wall 150*a* and the second wall 150*b*, refer to FIG. 1). As viewed from the third wall 150*c*, the hopper 1, the screening unit 40, a blower 37, and the defibrating unit 20 are provided in this order on plural non-illustrated supporting tables over the base 150*e*.

The defibrating unit 20 is located at the rear side of the sheet manufacturing apparatus 100. In other words, for example, the defibrating unit 20 is located at a position closer to the second wall 150*b* with respect to the center of the apparatus body 150. Furthermore, the defibrating unit 20 is located adjacent to the second wall 150*b* inside the apparatus body 150. As described above, since the dry-type defibrating unit 20, which produces a loud noise, is located inside the apparatus body 150 at a position distant from the operation unit 141, a noise reduction is achieved.

Though it is explained above that the side where the operation unit 141 is located is the front side, the scope of the invention is not limited thereto. The direction of the shorter sides in the installation area of the sheet manufacturing apparatus 100 may be taken as the front-rear (depth) direction, with the defibrating unit 20 located at the rear side. This is because, when an apparatus is installed in an office, etc., it is common that one of the longer sides is along an office wall, with the shorter sides taken in the depth direction.

The defibrating unit 20 is located at one end side of the sheet manufacturing apparatus 100, and the hopper 1 is located at the opposite end side of the sheet manufacturing apparatus 100. Therefore, the defibrating unit 20 and the hopper 1 are distant from each other inside the sheet manufacturing apparatus 100. For this reason, noise produced by the defibrating unit 20 attenuates inside the pipe 2 before it goes out from the opening of the hopper 1, resulting in a noise reduction.

The one end and the opposite end of the sheet manufacturing apparatus 100 can be paraphrased as the third wall 150*c* and the fourth wall 150*d* of the apparatus body 150. The "one end side" of the sheet manufacturing apparatus 100 means a position closer to one end with respect to the bisection position when the sheet manufacturing apparatus 100 is bisected. The "opposite end side" of the sheet manufacturing apparatus 100 means a position closer to the opposite end with respect to the bisection position when the sheet manufacturing apparatus 100 is bisected.

The longer the distance between the defibrating unit 20 and the hopper 1 is, the greater the attenuation of noise is. Therefore, preferably, the defibrating unit 20 and the hopper 1 should be located at respective positions that maximize the distance therebetween inside the sheet manufacturing apparatus 100. That is, the defibrating unit 20 should be located in the neighborhood of, preferably adjacent to, the fourth wall 150*d*, and the hopper 1 should be located in the neighborhood of, preferably adjacent to, the third wall 150*c*.

In the direction of transportation of crushed pieces, the pipe 2 located upstream of the defibrating unit 20 includes a sound muffling unit 21. Since the sound muffling unit 21 is provided, it is possible to reduce noise produced at the defibrating unit 20.

Either a single muffler or plural mufflers may be provided somewhere in the pipe 2 as the sound muffling unit 21. The sound muffling unit 21 should preferably be located over the defibrating unit 20, and should preferably be located somewhere in the pipe 2 extending upward from the defibrating unit 20. Since the sound muffling unit 21 mentioned below has many openings, for the purpose of preventing the openings of the sound muffling unit 21 from being clogged by crushed pieces caught in the openings, preferably, the sound muffling unit 21 should be located somewhere in the pipe 2 extending in an upward direction from the defibrating unit 20. The term "upward direction" encompasses a substantially perpendicular direction that is inclined from a perpendicular direction within a range in which it is possible to prevent the openings from being clogged by crushed pieces. For example, it may be inclined by 45° from the perpendicular direction.

The pipe 2 is inclined from the position under the hopper 1 toward the position over the defibrating unit 20. Since the pipe 2 is inclined, it is possible to make the pipe 2 longer inside the apparatus body 150, resulting in a greater noise reduction. Because of the inclined installation of the pipe 2, a part of the pipe 2 extends upward from the defibrating unit 20. Therefore, it is possible to provide the sound muffling unit 21 in the part extending upward.

Preferably, the slope of the pipe 2 should be as gentle (small inclination) as possible. Since the airflow produced by the defibrating unit 20 is utilized for transporting the raw material through the pipe 2, the gentler slope of the pipe 2 makes the transportation of the raw material easier. In order to make the slope of the pipe 2 gentler, preferably, the defibrating unit 20 should be provided at a low position in the sheet manufacturing apparatus 100, for example, on or over the base 150*e*. For example, the defibrating unit 20 is installed on a vibration-proof rubber pad over the base 150*e*. With the use of such vibration-proof rubber, it is possible to dampen the vibration of the defibrating unit 20 and reduce noise produced as a result of the transmission of the vibration to the base 150*e*. Though the slope of the pipe 2 would become gentler if the hopper 1 were located at a high position in the sheet manufacturing apparatus 100, actually, it is inevitable that the position of the hopper 1 will be low because of the position of the supplying unit 10 described earlier.

The blower 37 produces the flow of air inside the pipe 3 to transport the defibrated material from the defibrating unit 20 to the classifying unit 30.

The classifying unit 30 includes the cylindrical portion 32, which is a cyclone-shaped body, and the receiver portion 36, which is a catcher that is connected to the upper outlet 35 of the cylindrical portion 32 and catches a discharged material (second classified material) put out through the upper outlet 35. The cylindrical portion 32 is located at the rear side of the sheet manufacturing apparatus 100. The receiver portion 36 is located at the front side of the sheet manufacturing apparatus 100. Since the receiver portion 36, which requires maintenance after a predetermined period of use, is located at the front side of the sheet manufacturing apparatus 100, the ease of maintenance of the receiver portion 36 improves. The discharged material put out through the upper outlet 35, which is the top opening of the cylindrical portion 32, is transported through the pipe 5 between the cylindrical portion 32 and the receiver portion 36. The pipe 4 extending from the inverted cone portion 33 under the cylindrical portion 32 is obliquely connected to an upper portion of the screening unit 40. The defibrated material that has been classified at the classifying unit 30 (the first classified material) is transported to the screening unit 40 through the pipe 4.

The screening unit 40 includes a sieve 45. The screening unit 40 separates the defibrated material after defibration by the defibrating unit 20 into a passing-through material, which passes through the sieve 45, and a non-passing-through material, which does not pass through the sieve 45. In the direction of transportation of crushed pieces from the hopper 1 to the defibrating unit 20, the screening unit 40 is located between the hopper 1 and the defibrating unit 20. Since the screening unit 40 is located in a space formed by arranging the hopper 1 and the defibrating unit 20 at a distance from each other, space-efficient arrangement and a noise reduction are achieved.

The screening unit 40 has the hopper 6 under its body. After screening, the first screened material is transported from the screening unit 40 to the mixing unit 50, which is located at the front side, through the pipe 54.

The screening unit 40 has the pipe 8 and the outlet 44, through which the non-passing-through material is put out. The outlet 44 is an opening formed at the third-wall side 150*c* of the screening unit 40. One end of the pipe 8 is connected to the outlet 44. The opposite end thereof is open over the hopper 1. The hopper 1 is located at a position where the non-passing-through material falls from the outlet 44 due to its own weight. Therefore, the non-passing-through material screened out by the screening unit 40 is put out into the hopper 1 along the pipe 8 due to its own weight without any transportation force by a blower or the like.

3. Front Transportation Line

Figure 4:
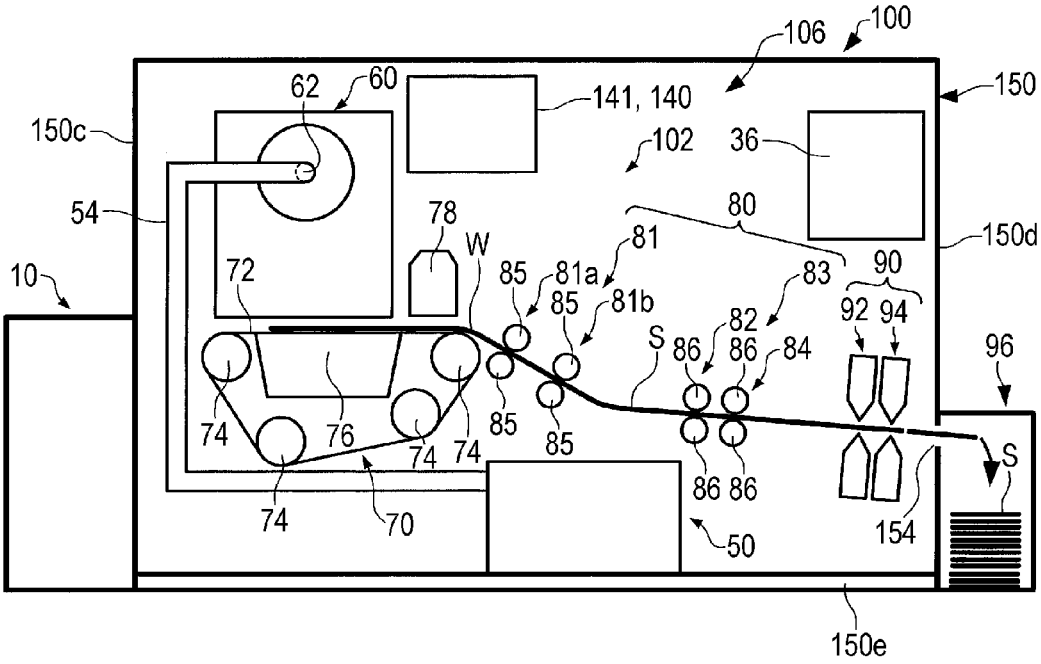
FIG. 4 is a front view of the sheet manufacturing apparatus of the embodiment.

With reference to FIG. 4, the front transportation line B will now be explained in detail. FIG. 4 is a front view of the sheet manufacturing apparatus 100 according to the present embodiment.

As illustrated in FIG. 4, the forming unit 106, which forms a sheet S by using at least a part of a defibrated material, is provided on the front transportation line B. Since the forming unit 106 is located at the front side, trouble-shooting is easier when a trouble occurred in the transportation of the sheet S in the forming unit 106.

On the front transportation line B, the mixing unit 50, which mixes the first defibrated material sent from the rear transportation line A by the blower 56, is mounted on the base 150*e* near the center in the width direction of the apparatus body 150, and the deposition unit 60 is located above the mixing unit 50 near the third wall 150*c*. The web W and the sheet S are formed and transported from the position under the deposition unit 60 toward the fourth wall 150*d*. The web forming unit 70, the moisture-adjusting unit 78, the sheet forming unit 80, and the cutting unit 90 are arranged in this order from the position under the deposition unit 60 in the direction of transportation of the web W and the sheet S.

The ejection receiver unit 96 is located outside the apparatus body 150 adjacent to the fourth wall 150*d*. The ejection receiver unit 96 receives the sheet S ejected through an ejection opening 154, which is formed through the fourth wall 150*d*. For the same reason as that described earlier regarding the supplying unit 10, preferably, if possible, the ejection receiver unit 96 should be installed at a low position in the sheet manufacturing apparatus 100. Such a structure makes it easier to troubleshoot a sheet jam that occurred during ejection.

The arrangement of the deposition unit 60 and the web forming unit 70 at the third-wall side 150*c* and the ejection receiver unit 96 at the fourth-wall side 150*d* makes it possible to utilize the entire length from the third wall 150*c* to the fourth wall 150*d* in the length direction inside the apparatus body 150 for the forming of the web W and the sheet S.

The forming unit 106 includes the deposition unit 60 for deposition of at least a part of the defibrated material, the heating rollers 86 for heating the deposited material, and pressing rollers 85 for pressing the deposited material. The heating roller 86 needs to be replaced after a predetermined amount of use because of heat stress. The pressing roller 85 also needs to be replaced after a predetermined amount of use because of pressure stress. Since the forming unit 106, which includes these rollers 85 and 86, is located at the front side, replacement is easier.

The operation unit 141 is located on the top at the center area of the first wall 150*a*, which is the front wall of the apparatus body 150, so as to be easily accessible by an operator of the sheet manufacturing apparatus 100. The operation unit 141 on the top of the first wall 150*a*, which is not illustrated in FIG. 4, includes, for example, a display unit that displays various kinds of processing conditions and the status of each of the processing units, and an input means for inputting various conditions, etc. by an operator.

Though the sheet manufacturing apparatus of the above example is a dry-type apparatus, the sheet manufacturing apparatus of the present invention may be a wet-type apparatus. For example, a disintegrating unit (pulper) may be used in place of the defibrating unit 20, a deinking unit may be used in place of the classifying unit 30, and a pulp molding unit may be used in place of the sheet forming unit 80.

The sheet S manufactured by the sheet manufacturing apparatus of the present invention mainly means a sheet-shaped matter. However, it is not limited to a sheet-shaped matter. It may be a board-shaped matter or a web-shaped matter. The sheet in this specification can be classified into paper and nonwoven fabric. The paper is made of pulp or wastepaper, and includes a thin sheet, etc., for example, writing paper, printing paper, wallpaper, wrapping paper, colored paper, drawing paper, or Kent paper. The nonwoven fabric is sheet fabric that is thicker and less strong than paper, for example, popular nonwoven fabric, fiber board, tissue paper (cleaning tissue paper), paper towel (kitchen paper), a cleaner, a filter, a liquid (waste-ink, oil) absorber, a sound-absorbing material, a cushioning material, or a mat. Its raw material may be plant fiber such as cellulose, chemical fiber such as PET (polyethylene terephthalate) or polyester, or animal fiber such as wool or silk.

In the present invention, a partial omission of elements or a combination of embodiments and variation examples may be made within the range of features and effects thereof.

The present invention includes any structure that is substantially the same as the structure described in the embodiment (structure with the same function, method, and result, or structure with the same object and effect). The present invention includes any structure obtained by replacement of a non-essential part in the structure described in the embodiment. The present invention includes any structure that produces the same operational effect as that of the structure described in the embodiment, or any structure that achieves the same object as that of the structure described in the embodiment. The present invention includes any structure obtained by addition of known art to the structure described in the embodiment.

The entire disclosure of Japanese Patent Application No. 2014-251803, filed Dec. 12, 2014 is expressly incorporated by reference herein.

What is claimed is:

1. A sheet manufacturing apparatus, comprising:

a hopper that receives a material containing a fiber;

an impeller mill that produces a flow of air, receives the material from the hopper, defibrates the material, and outputs the defibrated material;

a screening unit configured to screen the defibrated material based on length of pieces of the defibrated material;

a web forming unit configured to form a web from at least a part of the defibrated and screened material;

a heating roller, which applies heat to the web, which contains the defibrated material, to form a sheet; and a pipe between the impeller mill and the hopper, the pipe including a sound muffling unit configured to attenuate noise produced by the impeller mill.

2. The sheet manufacturing apparatus according to claim 1, wherein the hopper is located at one end side of the apparatus and the impeller mill is located at the opposite end side of the apparatus.

3. The sheet manufacturing apparatus according to claim 1, wherein the pipe is arranged to be inclined.

4. The sheet manufacturing apparatus according to claim 1, the apparatus further comprising:

an operation unit configured to operate the sheet manufacturing apparatus;

wherein, when a side where the operation unit is located is defined as a front side, the impeller mill is located at a rear side, and the heating roller is located at the front side.

* * * * *